United States Patent [19]

Amano et al.

[11] Patent Number: 4,619,595

[45] Date of Patent: Oct. 28, 1986

[54] CAPACITY CONTROL DEVICE FOR COMPRESSOR

[75] Inventors: Keijiro Amano, Mito; Isao Hayase, Katsuta; Atsuo Kishi, Katsuta; Noriharu Sato, Katsuta, all of Japan

[73] Assignees: Hitachi, Ltd., Tokyo; Hitachi Automotive Engineering Co., Ltd., Katsuta, both of Japan

[21] Appl. No.: 600,903

[22] Filed: Apr. 16, 1984

[30] Foreign Application Priority Data

Apr. 15, 1983 [JP] Japan ..... 58-65619

[51] Int. Cl.[4] ..... F04C 18/00

[52] U.S. Cl. ..... 418/83; 418/259

[58] Field of Search ..... 418/259, 266–270, 418/86, 61 A, 83

[56] References Cited

U.S. PATENT DOCUMENTS 3,280,802 10/1966 Froede ..... 418/83

3,964,445 6/1976 Ernest ..... 418/83

4,104,010 8/1978 Shibuya ..... 418/268

4,486,158 12/1984 Maruyama ..... 418/39

FOREIGN PATENT DOCUMENTS 135396 8/1983 Japan ..... 418/259

*Primary Examiner*—Leonard E. Smith

*Assistant Examiner*—Jane E. Obee

*Attorney, Agent, or Firm*—Antonelli, Terry & Wands

[57] ABSTRACT

A capacity control device for a compressor used with an air conditioning system for an automotive vehicle and driven by an engine of the automotive vehicle, including flow resistance portions provided in a refrigerant inlet passage and capable of reducing the flow rate of a refrigerant flowing into working chambers of the compressor as the rotational speed of the compressor (or the engine speed) rises, to thereby reduce the volumetric efficiency of the compressor in a high engine speed range.

3 Claims, 10 Drawing Figures

CAPACITY CONTROL DEVICE FOR COMPRESSOR

BACKGROUND OF THE INVENTION

This invention relates to a capacity control device for a compressor suitable for use with an air conditioning system for an automotive vehicle.

Control of cooling capabilities of an air conditioning system used with an automotive vehicle is effected by adjusting the degree of opening of an expansion valve located at an inlet of an evaporator in accordnace with the degree of superheating of a refrigerant at an outlet of the evaporator (the degree of superheating being a function of the temperature of the refrigerant at the outlet of the evaporator and its pressure at the inlet of the evaporator, and varying depending on a thermal load applied to the evaporator), to thereby control the volume of the refrigerant flowing in circulation through the refrigeration cycle.

Generally, the expansion valve is constructed such that it is not fully closed even when the thermal load is low and kept at a predetermined low degree of opening because of the need to return at all times a lubricant to the compressor, the lubricant having flowed out of a compressor to the refrigeration cycle.

Since the compressor of an air conditioning system for an automotive vehicle is rotatably driven by an engine of the vehicle for rotation, the flow rate of the refrigerant flowing through the refrigeration cycle varies in dependence upon the number of revolutions of the engine (i.e. engine speed) even if the degree of opening of the expansion valve is kept constant.

Thus, in the condition that the thermal load is low and expansion valve is kept at a lowest degree of opening, if the engine speed rises as the vehicle is operated at high speed because as of acceleration, ascending a slope or passing another vehicle, the number of revolutions of the compressor would also rise and the flow rate of the refrigerant would exceed a desired level.

As a result, the evaporator would freeze and the heat exchange rate would drop to a very low level, resulting in a malfunctioning of the evaporator. To avoid this phenomenon, it is a usual practice to provide a freezing prevention means for temporarily rendering the compressor inoperative by monitoring the temperature of the air exhausted through the evaporator or the surface temperature of the evaporator itself. However, stopping and reactivating the compressor rotating at high speed would shorten the service life of the compressor and an electromagnetic clutch. If the compressor is reactivated before the balance is redressed between the pressure at the suction side of the compressor and the pressure at its discharge side, the torque required for restarting the compressor would be high and cause a variation to occur in the load applied to the engine, thereby deteriorating the traveling performance of the vehicle. (If this phenomenon occurs when the vehicle ascends a slope or accelerates, the engine might stop.)

To avoid this problem, a proposal has been made in Japanese Patent Laid-Open No. 26969/82 to effect control of the capacity of a compressor by controlling the number of revolutions of the compressor in accordance with the magnitude of a thermal load irrespective of the engine speed.

The proposal may be effective but it uses a variable pulley and means for controlling the variable pulley in accordance with the thermal load to control the number of revolutions of the compressor. This renders the construction complex and causes a rise in cost.

SUMMARY OF THE INVENTION

This invention has as its object the provision of a low cost capacity control device for a compressor which enables the capacity of the compressor to be controlled satisfactorily when the number of revolutions of the compressor rises as the engine speed rises, by preventing an excess inflow of a refrigerant into a cylinder of the compressor, without requiring means of a complex construction for controlling the number of revolutions of the compressor.

The outstanding characteristic of the invention is that flow resistance portions are provided in an intermediate portion of refrigerant inlet passage of the compressor. The flow resistance portions reduce the volume efficiency of the compressor as the engine speed rises.

DETAILED DESCRIPTION

Figure 1:
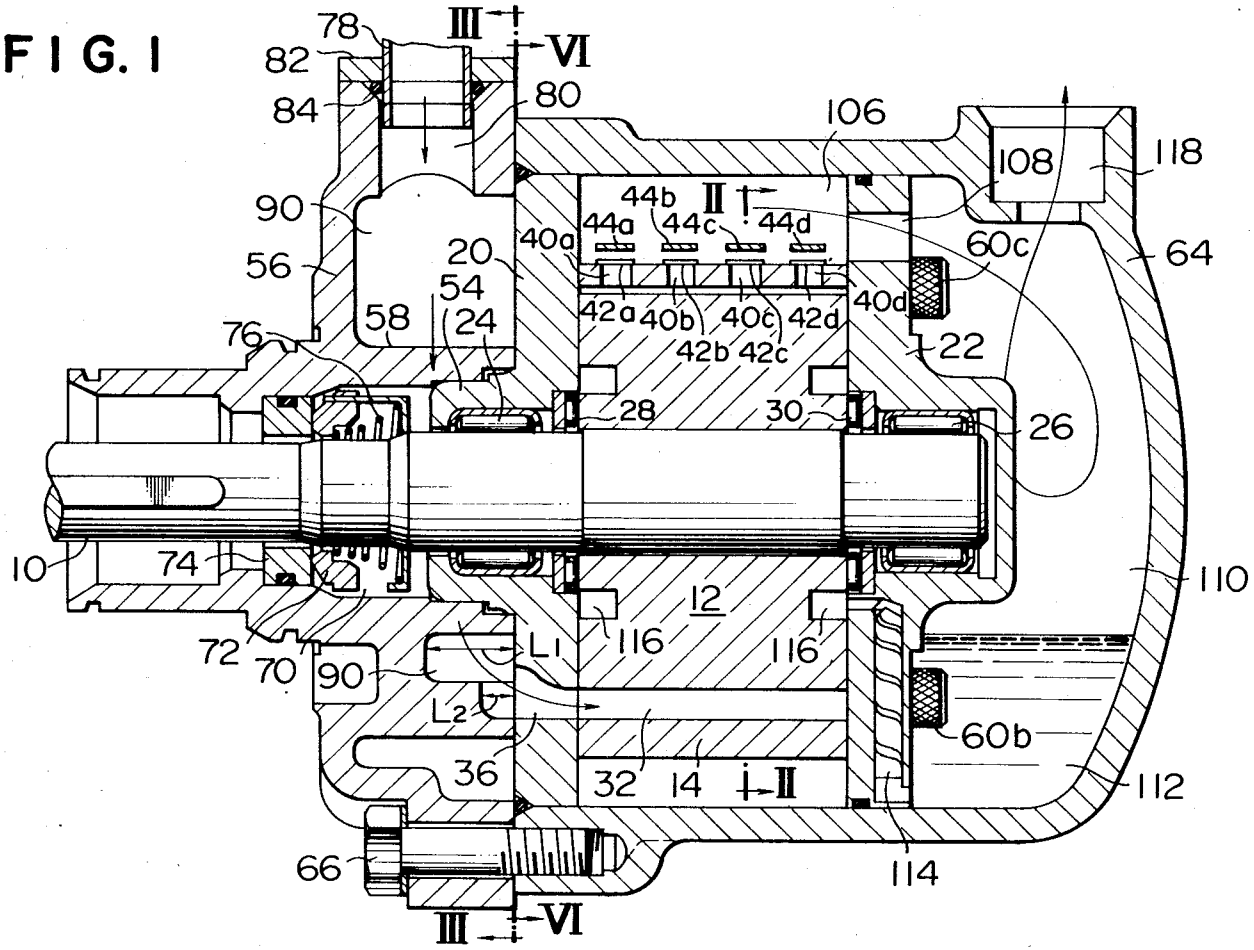
FIG. 1 is a vertical sectional view of the compressor incorporating therein one embodiment of the capacity control device in accordance with the invention.
Figure 2:
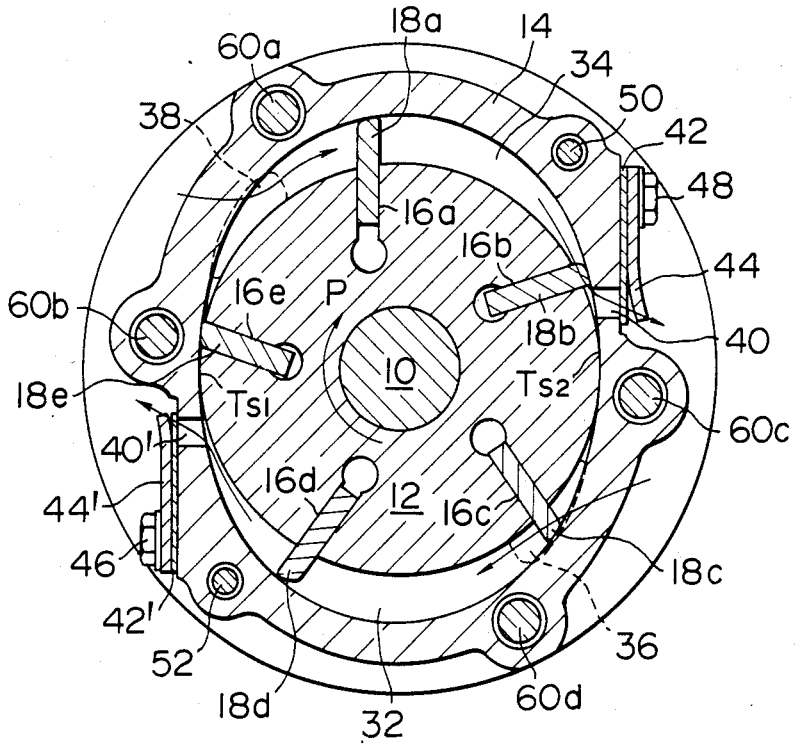
FIG. 2 is a sectional view taken along the line II—II in FIG. 1.
Figure 3:
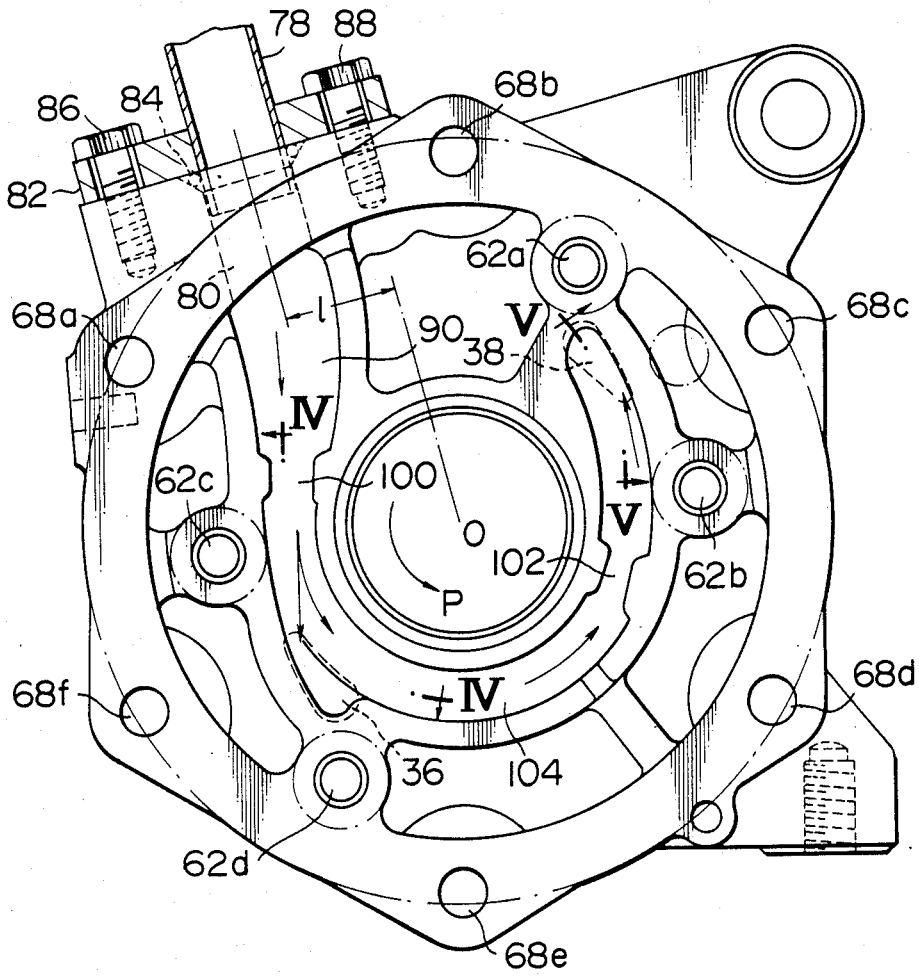
FIG. 3 is a sectional view taken along the line III—III in FIG. 1.

Referring now to the drawings wherein like reference numerals are used throughout the various views to designate like parts and, more particularly, to FIGS. 1–3, according to these figures, a movable vane type compressor includes a rotary shaft 10 rotatably driven by an engine of an automtoive vehicle through an electromagnetic clutch, not shown. A rotor 12, housed in a cam cylinder 14 is secured to the rotary shaft 10.

As shown in FIG. 2, the rotor 12 has a circular outer peripheral surface centered at the axis of the rotary shaft 10. The cam cylinder 14 has an inner peripheral surface which is in contact with the outer peripheral surface of the rotor 12 at two tangent seal points $T_{s1}$ and $T_{s2}$. The inner peripheral surface of the cam cylinder 14 is typically an epitrocoidal curve. The rotor 12 is formed with a plurality of substantially radially vane grooves 16*a* to 16*e* respectively for receiving vanes 18*a* to 18*e* for radial movement in the respective vane grooves 16*a*–16*e*. During the rotation of the rotor 12, the vanes 18*a* to 18*e* are maintained at their outmost ends in contact with the inner peripheral surface of the cam cylinder 14.

Side plates 20 and 22 are secured to opposite axial ends of the cam cylinder 14 so as to substantially seal the interior of the cam cylinder 14. Radial bearings 24 and 26 are respectively mounted in central portions of the side plates 20, 22 for journaling the rotary shaft 10. Thrust bearing 28, 30 are mounted in central portions of inner end faces of the side plates 20, 22, respectively. The side plates face respective end faces of the rotor 12, so that the axial movement of the rotor 12 is borne by the thrust bearings 28, 30.

Two working chambers 32, 34 are formed in the cam cylinder 14 and defined by the outer peripheral surface of the rotor 12, the inner peripheral surface of the cam cylinder 14 and the inner end faces of the side plates 20, 22. The volumes of the working chambers 32 and 34 vary as the vanes 18*a* to 18*e* rotate together with the rotor 12.

The side plate 20 is formed with a plurality of suction ports 36, 38 for sucking a refrigerant into the working chambers 32 and 34. The positions of the suction ports 36, 38 may be advantageously located in a range in which the vanes 18*a* to 18*e* move radially outwardly after passing the points $T_{s1}$ and $T_{s2}$.

A wall of the cam cylinder 14 is formed with discharge port means 40, 40' each comprising four ports 40*a* to 40*d* and 40'*a* to 40'*d*, respectively, communicating with the working chambers 32, 34. The port means 40, 40' are provided with reed valves 42*a* to 42*d* and valve seats 44*a* to 44*d* and reed valves 42'*a* to 42'*d* and valve seats 44*a'* to 44*d'* respectively. The valve seats 44*a* to 44*d* and 44'*a* to 44'*d*, are in the form of combs and secured at their roots to an outer peripheral wall surface of the cam cylinder 14 by screws 46 and 48.

The side plates 20, 22 are positioned in place with respect to the cam cylinder 14 by knock pins 50, 52 and temporarily clamped thereto. The side plate 20 is formed in a central portion of its outer end face with a projection 54 for holding the bearing 24 in a manner to enclose the shaft 10. A side cover 56 is fitted to one side of the side plate 20 and formed in a central portion of its inner surface with a cylindrical portion 58 which defines a shaft seal chamber 70. The cylindrical portion 58 is press-fitted at its inner peripheral surface over the projection 54 of the side plate 20 at its outer peripheral surface.

Screws 60*a* to 60*d* extend through the side plate 22, cam cylinder 14 and side plate 20 to an inner wall surface of the side cover 56 where they are threadably fitted in threaded openings 62*a* to 62*d*, respectively (FIG. 3).

Thus, a compressor assembly comprising the side plates 20, 22 and the cam cylinder 14 held therebetween is firmly secured to the side cover 56.

After assembly, the compressor assembly is inserted through an open end of a bowl-shaped casing 64 into the interior thereof, and then the side cover 56 and casing 64 are secured to each other by screws 66. Openings 68*a*–68*f* are provided for enabling an insertion of screws, not shown, for the purpose of securing the cover 56 and casing 64.

Disposed in the shaft seal chamber 70 are a rotary ring 72 secured to the shaft 10 for rotation therewith, and a spring 76 pressing the rotary ring 72 against a fixed ring 74 secured to an inner wall surface of the seal chamber 70.

An inlet port 80 is formed in a wall of the side cover 56 and connected with a lower pressure line 78 of the refrigeration cycle. A flange 82 is joined by brazing to an end portion of the lower pressure line 78. A surface of the side cover 56, surrounding the inlet port 80, is flat and has the flange 82 in contact therewith through a seal ring 84 and is secured thereto by screws 86, 88. The opening of the inlet port 80 is oriented in such a manner that currents of a refrigerant drawn by suction into the compressor from the lower pressure line 78 flow in the direction of rotation of the rotor 12 and substantially tangentially to an outer wall surface of the cylindrical portion 58.

The side cover 56 is recessed at its inner wall surface to define a refrigerant inlet passage 90 through which the refrigerant drawn by suction through the inlet port 80 flows in the direction of rotary movement of the rotor 12. The refrigerant inlet passage 90 is maintained in communication with the suction port 36 which opens in the working chamber 32 and terminates in a position in which it is maintained in communication with the suction port 38 which opens to the working chamber 34. The refrigerant inlet passage 90 is shaped such that as it extends from the initiating position, in which it is connected with the inlet port 80, toward the terminating position, in which it is communicated with the suction port 36, its cross-sectional area is gradually reduced. With the refrigerant inlet passage 90 being shaped as described above, the flow velocity of the refrigerant through the refrigerant inlet passage 90 from the inlet port 80 to the terminating position of the passage 90 is substantially constant, thereby making it possible to avoid a loss of pressure which might otherwise be caused by a sudden drop in the flow velocity of the refrigerant.

Figure 5:
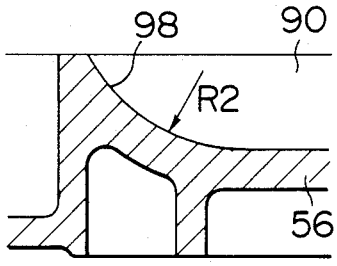
FIG. 5 is a sectional view taken along the line V—V in FIG. 3.
Figure 6:
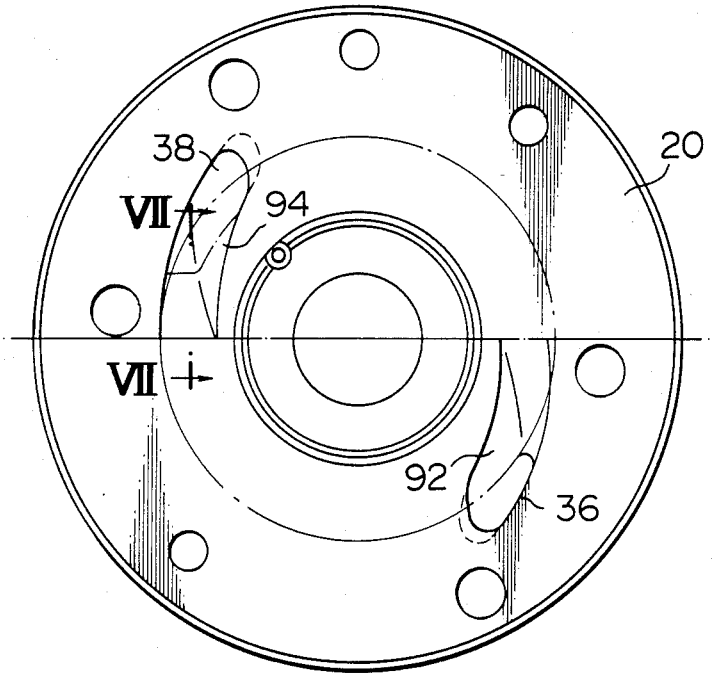
FIG. 6 is a sectional view taken along the line VI—VI in FIG. 1.
Figure 7:
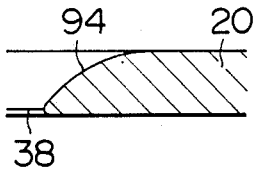
FIG. 7 is a sectional view taken along the line VII—VII in FIG. 6.

As shown in FIGS. 6 and 7, grooves 92, 94 of a predetermined curvature are formed in the side plate 20 at an entrance to the suction ports 36, 38, respectively to enable the refrigerant flowing from the refrigerant inlet passage 90 into the suction ports 36 and 38 to be diverted smoothly. The side cover 56 is formed on its wall surface facing the grooves 92, 94 with guide surfaces 96, 98 which, as shown in FIGS. 4 and 5, have curvatures R1 and R2, respectively, for guiding the flow of the refrigerant.

The provision of the grooves 92, 94 and the guide surfaces 96, 98 has the effect of enabling the inflow of the refrigerant into the working chambers 32, 34 to smoothly take place by minimizing the flow resistance of the refrigerant through the passage 90.

Figure 4:
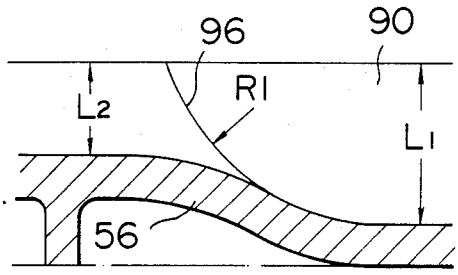
FIG. 4 is a sectional view taken along the line IV—IV in FIG. 3.

The refrigerant inlet passage 90 has its height (the spacing between the outer end face of the side plate 20 and an inner wall surface of the refrigerant inlet passage 90 on the side cover 56) reduced from $L_1$ to $L_2$ as shown in FIG. 4 immediately before and after it passes through the suction port 36. This is because it is necessary to reduce the cross-sectional area of the passage 90 as the flow rate of the refrigerant is reduced, in order that one-half the refrigerant drawn by suction through the suction port 80 may be sucked into the working chamber 32 and the flow velocity of the rest of the refrigerant through a portion of the passage 90 downstream of the suction port 36 may be rendered equal to the flow velocity through a portion of the passage 90 disposed upstream of the suction port 36.

By virtue of the structural arrangement described hereinabove, the pressure loss of the refrigerant drawn by suction through the inlet port 80 and flowing through the refrigerant inlet passage 90, which pressure loss might otherwise be caused by the resistance offered by the passage, is avoided in the entire range of the engine speed, thereby improving the volumetric efficiency of the compressor from the low engine speed range to the high engine speed range.

In this structural arrangement, an additional feature is that restrictors 100, 102 (FIG. 3) are provided in the refrigerant inlet passage 90 and located in discrete positions between its initiating position and its terminating position. The restrictor 100 is located between the inlet port 80 and the first suction port 36 in the side plate 20 and has a cross-sectional area which is about one-half that of the lower pressure line 78. The restrictor 102 has a cross-sectional area which is about one-half that of a refrigerant passage portion 104 located posterior to the suction port 36.

The above-described movable vane compressor operates as follows. As the rotor 12 rotates in the direction of an arrow P, the vanes 18 each make one complete reciprocatory movement of one cycle in the respective vane grooves 16, during passing from tangent seal points $T_{s1}$ to $T_{s2}$. A portion of the working chamber 34 (32) defined by the two vanes 18 is in a suction stroke from a time when one vane 18*a* (18*c*) has moved across the suction port 38 (36) until a time when the next following vane 18*c* (18*b*) finishes moving across the suction port 38 (36). Then, the working chamber, defined between the vanes 18*a* and 18*e* (vanes 18*c* and 18*b*) has, its volume gradually decreased in a compression stroke until the preceding vane 18*a* (18*c*) moves close to the discharge port 40 (40'). Thereafter, the same portion as described hereinabove of the working chamber 34 (32) comes into a discharge stroke from a time when the vane 18*a* (18*c*) moves across the discharge port 40 (40') until a time when the vane 18*e* (*b*) finishes moving across the discharge port 40 (40').

The refrigerant introduced through the lower pressure line 78 into the inlet port 80 flows through the refrigerant inlet passage 90 and suction port 38 into the working chamber 34 where it is compressed before being discharged therefrom through the discharge port 40 into a discharge section 106 and a duct 108 formed in the side plate 22, to be discharged into the discharge chamber 110.

Oil separating means, not shown, is are provided in the discharge chamber 110 for separating oil from the refrigerant discharged into the discharge chamber 110. The separated oil collects in an oil sump 112 located in a lower portion of the discharge chamber 110. The oil in the oil sump 112 is supplied by a pressure in the discharge chamber 110 to the thrust bearings 30 and 28, needle bearings 26, 24 and end faces of the rotor 12 through an oil restriction passage 114 and annular grooves 116 formed on the end faces of the rotor 12 to communicate with the vane grooves 16*a* to 16*e* at their backs. The refrigerant from which the oil has been separated in the discharge chamber 110 by the oil spearating means is led through a discharge port 118 to a higher pressure line of the refrigeration cycle.

Figure 8:
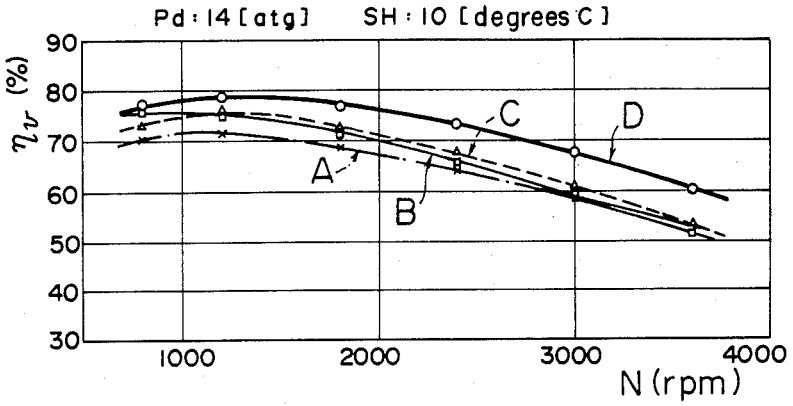
FIG. 8 is a diagram showing a comparison of the performance of the compressor incorporating therein the invention with the performance of a compressor of the prior art.

By virtue of the structural features that the compressor is provided with the refrigerant inlet passage 90, 104 of the aforesaid construction, the compressor has a lower pressure loss than compressors of the prior art in which refrigerant inlet passages are constituted by wide annular spaces provided by recesses formed at the side covers, thereby improving volumetric efficiency. In FIG. 8, a curve A represents the relationship between the volumetric efficiency $\eta_v$ of a compressor of the prior art, having a discharge pressure Pd of 14 (atg) and a superheat SH of 10 (degrees C.), and the engine speed N (rpm), and a curve D indicates the same relationship established when the embodiment of the invention shown and described but without restrictors 100, 102. A comparison of the two curves A and D shows that the compressor incorporating the invention shows an improvement of 6–10% in volumetric efficiency in speeds ranges all engine speeds.

The restrictors 100, 102 of the above described embodiment function as the so-called flow resistances. More sepcifically, when the engine speed is low (or the refrigerant has a relatively low flow velocity), they offer a relatively small resistance ot the flow of a fluid. As the engine speed increases, the resistance offered to the fluid by the restrictors 100, 102 rises in a quadratic curve and the resistance offered gradually becomes large. The restrictor 100 acts as aforesaid on the flow of refrigerant into the suction ports 36, 38, and the restrictor 102 acts only on the flow of refrigerant into the suction port 38.

Thus, the resistance offered by the refrigerant inlet passage 90, 104 varies depending on the engine speed in such a manner that it is relatively low when the engine speed is low and it gradually rises as the engine speed increases.

As a result, in the embodiment having the restrictors 100, 102, the as shown in a curve C of FIG. 8, volumetric efficiency is improved 2 to 5% in the range of intermediate and low engine speeds by no appreciable improvement in shown in the range of high engine speed as compared with a characteristic A of the compressor of the prior art.

Thus, the compressor incorporating the invention has a higher volumetric efficiency in the range of low engine speed than compressors of the prior art, but its volumetric efficiency is not different from those of compressors of the prior art in the range of high engine speed.

It will be seen that the improvement restricts a rise in the flow rate of the refrigerant accompanying a rise in the engine speed, without reducing the flow rate of the refrigerant in the range of low engine speed. This is conducive to avoidance of an unnecessary rise in refrigerating capabilities in the range of high engine speed and reduction of consumption of the engine power.

Figure 9:
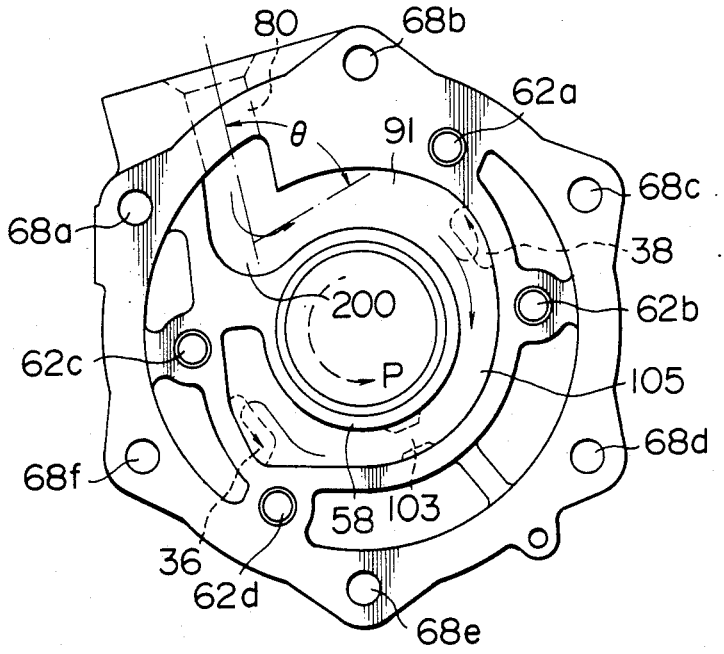
FIGS. 9 and 10 show the compressor incorporating therein another embodiment of the capacity control device in accordance with the invention.
Figure 10:
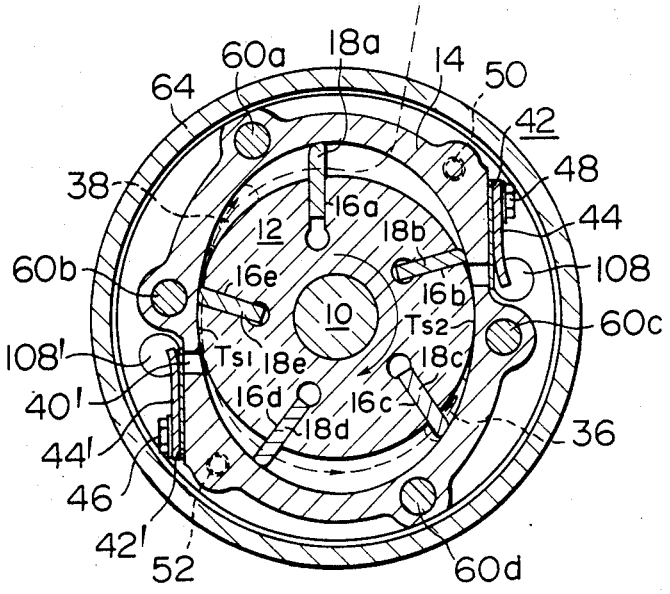

In the embodiment of FIGS. 9 and 10, a refrigerant inlet passage 91, 105 is formed such that a refrigerant flows therethrough in a direction opposite to the direction of rotation of the rotor 12.

Like the inlet port 80 of the embodiment shown in FIGS. 1–7, the inlet port 80 of the embodiment of FIGS. 9 and 10 is oriented such that currents of the refrigerant flowing therethrough into the compressor flow in the direction of rotation of the rotor 12 and substantially tangentially to an outer wall surface of the cylindrical portion defining the shaft seal chamber 70.

A bent portion 200 having a diverting angle $\theta$, which is larger than 90° and preferably about 100°, is formed in the refrigerant inlet passage 91 in a position between a flow initiating position and an extension from the inlet port 80. Like the refrigerant inlet passage 90 of the embodiment shown in FIGS. 1–7, the refrigerant inlet passage 91 has its cross-sectional area reduced by about one-half immediately after passing through the first suction port 38, to form the passage section 105. An inner wall surface of a portion of the refrigerant inlet passage 91 which is juxtaposed against the suction port 38 is in the form of a curved surface or guide surface closing at the divergingly tapering end of the suction port 38, so as to smoothly guide the refrigerant flowing toward the suction port 38. The refrigerant flowing into the suction port 38 away from the current of the refrigerant flowing through the refrigerant inlet passage 91 is drawn by suction into the working chamber after being diverted about 180°.

In the compressor incorporating the embodiment of of FIGS. 9 and 10, the bent portion 200 at the refrigerant inlet passage 91 performs substantially the same function as the restrictor of the embodiment shown in FIGS. 1–7. The bent portion 200 offers substantially no resistance to the flow of the refrigerant in the range of low engine speed. However, as the engine speed increases, the resistance offered to the flow of the refrigerant increases, to thereby restrict the flow rate of the refrigerant flowing therethrough to control volumetric efficiency.

In the diagram shown in FIG. 8, a curve B shows that when the engine speed is 800 rpm, the embodiment of the invention has a volumetric efficiency of 76% which is higher by 7% than the prior art represented by the curve A, but that the volumetric efficiency gradually falls as the engine speed increases. At 3000 rpm, the volume efficiency of the embodiment of the invention rather becomes lower than that of the prior art. This phenomenon is believed to be accounted for by the fact that the current of refrigerant is diverted at the suction ports 38, 36 by about 180° and this offers a greater resistance to the flow of refrigerant in the range of high engine speed than in the range of low engine speed.

In the embodiment of FIGS. 9 and 10, the compressor has a highest volumetric efficiency when the engine speed falls to a lowest level. Thus, it will be seen that although the compressor can function at its highest volumetric efficiency when the vehicle is traveling slowly in the crowded street or waiting for the signal to change, the compressor has a volumetric efficiency much lower than that of a compressor of the prior art in the range of high engine speed. This is conducive to improved capacity control of the compressor.

As shown in FIG. 9, a restrictor 103 having a cross-sectional area of about one-half that of the passage section 105 may be provided to the passage section 105 as indicated by broken lines. By this arrangement, the flow rate of the refrigerant flowing into the working chamber 32 can be further reduced when the engine is oeprated at high speed, thereby increasing the above-mentioned effect achieved in controlling the capacity of the compressor.

In the embodiments shown and described hereinabove, the invention has been described as being incorporated in a movable vane type compressor. However, the invention is not limited to this specific type of compressor and may be incorporated in any type of compressor, such as a swash plate type compressor, a reciprocating vertical type compressor, a scroll type compressor, a radial type compressor, etc., which is driven for rotation by an engine and provided with a refrigerant inlet passage in which flow resistance portions can be formed.

From the foregoing description, it will be appreciated that according to the invention, flow resistance portions are formed in a refrigerant inlet passage of a compressor and the flow resistance portions function in such a manner that the volumetric efficiency of the compressor drops as the speed of an engine driving the compressor rises. By virtue of this feature, it is possible to avoid an unnecessary rise in the capabilities of the compressor irrespective of a change in thermal load when the engine speed rises, so that an additional stress which might otherwise be applied to the compressor when it does work which is not essential can be avoided and the consumption of the engine power can be reduced.

What is claimed is:

1. A compressor for an air conditioning system of an automotive vehicle, the compressor being adapted to be rotatably driven by an engine of the vehicle to cause a refrigerant to flow in circulation through a refrigeration cycle, the compressor comprising a rotary shaft, a cylindrical rotor secured to the rotary shaft, a cam cylinder housing said rotor and cooperating with the rotor to define at least one working chamber between an outer peripheral surface of the rotor and an inner peripheral surface of the cam cylinder, a pair of side plates located at axially opposite end portions of the cam cylinder to provide a seal to said working chambers at their sides, a side cover attached to a side of one of said pair of side plates, suction portions formed in one of said side plates and communicating with said working chamber, a refrigerant inlet passage formed in said side cover and connected at one end to a lower pressure line of the refrigerant cycle and at another end to the suction ports, a capacity control device comprising at least one flow resistance portion integrally formed in said side cover in said refrigerant inlet passage, said flow resistance portion functioning to reduce a volumetric efficiency of the compressor as the engine speed rises, and wherein said at least one flow resistance portion comprises a bent portion of the refrigerant inlet passage, the bent portion having a flow resistance characteristic equal to that of a restrictor of a cross sectional area which is about one-half a cross sectional area of the refrigerant inlet passage, the cross sectional area of the refrigerant inlet passage being measured at the connecting portion between the lower pressure line of the refrigeration cycle and the compressor.

2. A compressor for an air conditioning system of an automotive vehicle, the compressor being adapted to be rotatably driven by an engine of the vehicle to cause a refrigerant to flow in circulation through a refrigeration cycle, the compressor comprising a rotary shaft, a cylindrical rotor secured to the rotary shaft, a cam cylinder housing said rotor and cooperating with the rotor to define at least one working chamber between an outer peripheral surface of the rotor and an inner peripheral surface of the cam cylinder, a pair of side plates located at axially opposite end portions of the cam cylinder to provide a seal to said working chambers at their sides, a side cover attached to a side of one of said pair of side plates, suction portions formed in one of said side plates and communicating with said working chamber, a refrigerant inlet passage formed in said side cover and connected at one end to a lower pressure line of the refrigerant cycle and at another end to the suction ports, a capacity control device comprising at least one flow resistance portion integrally formed in said side cover in said refrigerant inlet passage, said flow resistance portion functioning to reduce a volumetric efficiency of the compressor as the engine speed rises, wherein said at least one flow resistance portion is located in an intermediate portion of the refrigerant inlet passage, wherein said refrigerant inlet passage is formed such that it allows the refrigerant to be supplied to the working chamber through the refrigerant inlet passage in the same direction as a rotation of the rotor, and wherein said at least one flow resistance portion comprises at least one restrictor having a cross-sectional area which is about one-half that of the lower pressure line of the refrigeration cycle.

3. A compressor as claimed in claim 2, wherein said working chambers are a plurality of working chambers arranged such that said refrigerant inlet passage is brought into communication succesively with said plurality of working chambers, and wherein said at least one flow resistance portion are a plurality of flow resistance portions located upstream of said plurality of working chambers respectively.

* * * * *